US006783594B2

(12) United States Patent
Fairweather et al.

(10) Patent No.: US 6,783,594 B2
(45) Date of Patent: Aug. 31, 2004

(54) SELF-ADJUSTING MOISTENER SYSTEM FOR A MAILING SYSTEM

(75) Inventors: James A. Fairweather, West Haven, CT (US); George T. Barrett, Stratford, CT (US); Edward C. Miller, Woodbridge, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/255,510

(22) Filed: Sep. 25, 2002

(65) Prior Publication Data

US 2004/0055533 A1 Mar. 25, 2004

(51) Int. Cl.[7] ..... B05C 1/06; B05D 1/28

(52) U.S. Cl. ..... 118/264; 118/268; 156/441.5; 156/578; 427/429

(58) Field of Search ..... 118/264, 268; 156/441.5, 578; 427/429

(56) References Cited

U.S. PATENT DOCUMENTS 1,018,592 A * 2/1912 Stacy ..... 118/265
5,531,828 A * 7/1996 Whang ..... 118/264
5,569,327 A 10/1996 Paradis et al. ..... 118/253
5,665,198 A 9/1997 Bieber et al. ..... 156/578
5,674,348 A 10/1997 DeFiguerido ..... 156/441.5
5,746,881 A 5/1998 Jenkins et al. ..... 156/578
5,807,463 A 9/1998 Boughton ..... 156/441.5
5,840,123 A 11/1998 Holbrook ..... 118/603
6,361,603 B1 3/2002 Salomon ..... 118/300

* cited by examiner

*Primary Examiner*—Laura Edwards
(74) *Attorney, Agent, or Firm*—Brian A. Lemm; Angelo N. Chaclas

(57) ABSTRACT

A self-adjusting moistening system for a mailing system is provided. The applicator is coupled to a float mechanism, placed in the reservoir of moistening fluid, by a spring. When the reservoir is full of moistening fluid, the spring is compressed, and therefore does not provide any force on the applicator. As the level of moistening fluid decreases, the height of the float mechanism in the reservoir will also decrease, thereby causing the spring to elongate. As the spring elongates, it will pull down on the applicator, thereby causing an increase in the force applied between the applicator and the wick. This increase in force provides a more uniform deposition of the moistening fluid to the envelope flap as the level of the moistening fluid in the reservoir varies from full to empty.

30 Claims, 3 Drawing Sheets

SELF-ADJUSTING MOISTENER SYSTEM FOR A MAILING SYSTEM

FIELD OF THE INVENTION

The invention disclosed herein relates generally to mailing systems, and more particularly to a self-adjusting moistener system for moistening an envelope flap of an envelope being processed by the mailing machine.

BACKGROUND OF THE INVENTION

Mailing systems, such as, for example, a mailing machine, often include different modules that automate the processes of producing mail pieces. The typical mailing machine includes a variety of different modules or subsystems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering module, i.e., applying evidence of postage to the mail piece. The exact configuration of the mailing machine is, of course, particular to the needs of the user.

In the moistening/sealing module, a moistening device includes an apparatus for moistening the glue line on flaps of envelopes in preparation for sealing the envelopes in either a mailing machine or an inserter, and may also include a mechanism for moistening a tape. Moistening devices generally fall into two categories: contact and non-contact moistening systems. Contact systems generally deposit a moistening fluid, such as, for example, water or water with a biocide, onto the glue line on a flap of an envelope by contacting the glue line with a wetted applicator. Non-contact systems generally spray the moistening fluid onto the envelope flap.

In contact systems, the wetted applicator typically consists of a contact media such as a brush, foam or felt. The applicator is in physical contact with a wick. The wick is generally a woven material, such as, for example, felt, or can also be a foam material. At least a portion of the wick is located in a reservoir containing the moistening fluid. The moistening fluid is transferred from the wick to the applicator by physical contact pressure between the wick and applicator, thereby wetting the applicator. An envelope flap is guided between the wick and applicator, such that the applicator contacts the glue line on the flap of the envelope, thereby transferring the moistening fluid to the flap to activate the glue. The flap is then closed and sealed, such as, for example, by passing the closed envelope through a nip of a sealer roller to compress the envelope and flap together, and the envelope passed to the next module for continued processing.

There are problems, however, with conventional contact moistening systems. For example, in conventional contact moistening systems, it is difficult to accurately control the quantity of moistening fluid being transferred from the applicator to the envelope flap. If not enough moistening fluid is applied ("under-wetting"), the envelope flap will not properly seal to the envelope body. If too much moistening fluid is applied ("over-wetting"), it can cause damage to the envelope and/or its contents. Excessive moistening can also negatively impact any printing performed on the envelope, such as, for example, a postage indicium. For example, if the printing is being done by an ink-jet printer, an excessive amount of moisture will cause the ink to run, thereby possibly rendering any printed information illegible.

There are several factors that contribute to the amount of moistening fluid deposited on the envelope flap. For example, the amount of moistening fluid deposited on the envelope is dependent upon the amount of moistening fluid in the reservoir. In many applications, the moistener fluid level varies over the entire range of the reservoir capacity (full to empty) before it is replenished. As the moistening fluid level decreases, the amount of moistening fluid deposited on the envelope flap also decreases. Testing has shown that approximately twice the amount of moistening fluid is deposited on an envelope when the reservoir is full as compared to when the reservoir is only one-eighth full for various wick materials. Testing has also indicated that a minimum amount of moistening fluid must be deposited on an envelope to adequately moisten the glue line of the envelope to ensure consistent sealing. When the reservoir is only one-eighth full, the amount of moistening fluid deposited on the envelope may not surpass this minimum amount, thereby resulting in low sealing rates. Attempts to correct this type of problem, such as, for example, by altering the wicking properties of the wick such that even when the level of fluid in the reservoir is low, the amount of moistening fluid wicked to the applicator is still sufficient to adequately moisten the envelope flap, have resulted in over-wetting conditions when the reservoir is full. This type of correction is, of course, unacceptable. Another factor that contributes to the amount of moistening fluid deposited on the envelope flap is the amount of moistening fluid transferred from the wick to the applicator. If more moistening fluid is transferred from the wick to the applicator, there will be more moistening fluid deposited on the envelope flap. The amount of moistening fluid transferred from the wick to the applicator is dependent, at least in part, on the amount of force acting between the applicator and the wick, i.e., the contact pressure between the applicator and wick. If too much pressure is applied, especially when the reservoir is full, an over-wetting condition can result. If not enough pressure is applied, especially when the reservoir is not full, an under-wetting condition can result.

Thus, there exists a need for a moistening system that can better control the distribution of moistening fluid on an envelope flap.

SUMMARY OF THE INVENTION

The present invention alleviates the problems associated with the prior art and provides a system and method to better control the distribution of moistening fluid on an envelope flap. The present invention provides a self-adjusting moistening system that compensates for a decrease in the amount of moistening fluid contained in the reservoir by automatically increasing the normal force between the applicator and wick as the moistening fluid level in the reservoir decreases. The self-adjusting system of the present invention provides better control over the amount of moistening fluid deposited on an envelope flap, thereby ensuring more consistent sealing, while also reducing the likelihood of an over-wetting condition when the reservoir is full.

In accordance with the present invention, the applicator is coupled to a float mechanism by a spring. The float mechanism is placed in the reservoir of moistening fluid. When the reservoir is full of moistening fluid, the spring is compressed, and therefore does not provide any force on the applicator. As the level of moistening fluid decreases, the height of the float mechanism in the reservoir will also decrease, thereby causing the spring to elongate. As the spring elongates, it will pull down on the applicator, thereby causing an increase in the force applied between the applicator and the wick. Accordingly, as the level of fluid decreases in the reservoir, the amount of force between the applicator and the wick, and therefore the amount of force applied between the applicator and envelope flap, proportionally increases. The proportional increase in force between the applicator and wick as the moistening fluid level decreases provides a more uniform deposition of the moistening fluid to the envelope flap as the level of the moistening fluid in the reservoir varies from full to empty.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate a presently preferred embodiment of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 1:
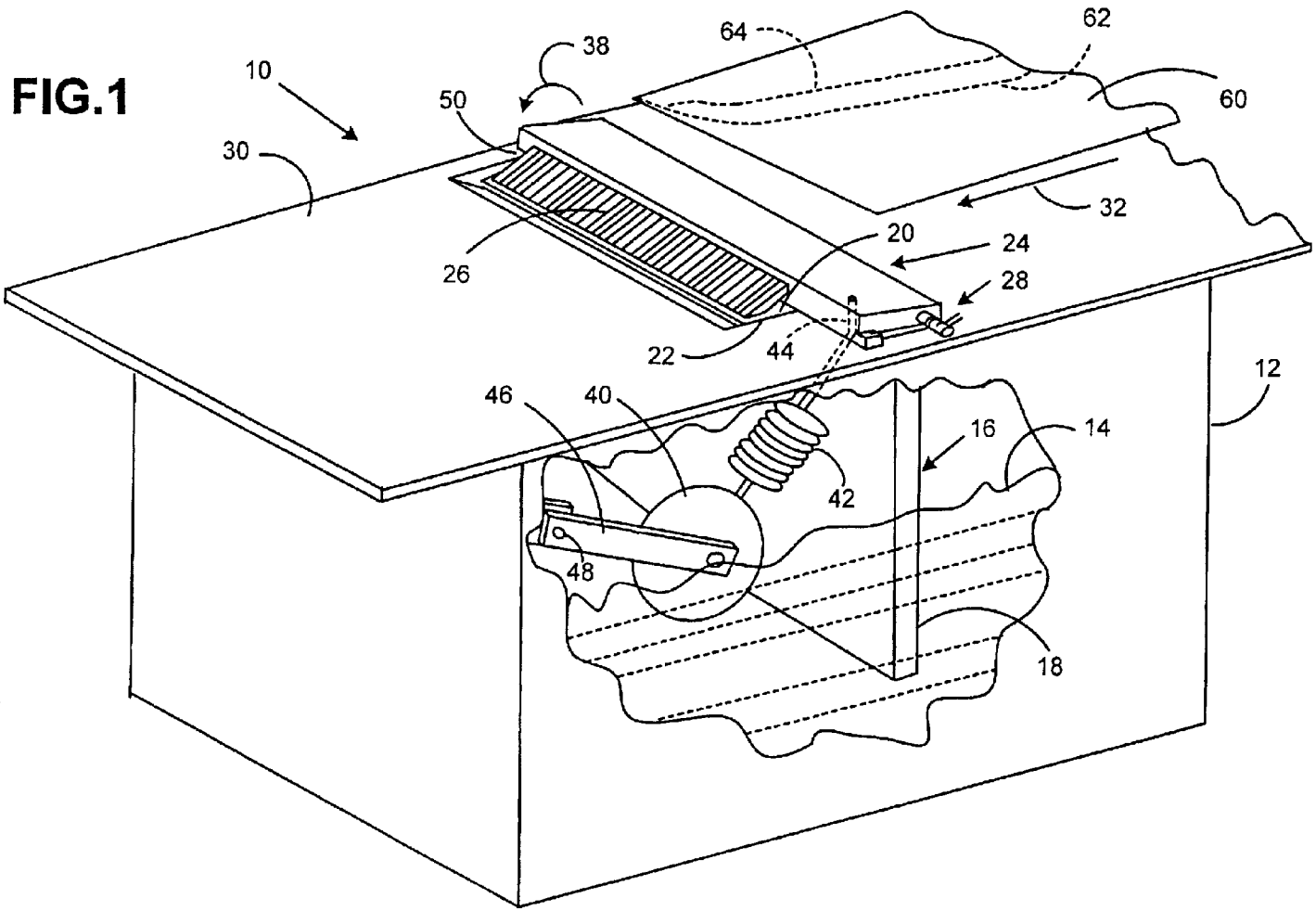
FIG. 1 illustrates a perspective view of a self-adjusting moistening system according to the present invention.

In describing the present invention, reference is made to the drawings, wherein there is seen in FIG. 1 a perspective view of a self-adjusting moistening system 10 according to the present invention. System 10 may be mounted in a mailing system (not shown), such as, for example, a mailing machine, inserter, envelope sealing system or other mailing and parcel delivery applications where media, such as, for example, mail pieces or tape are moistened for sealing or subsequent application to a mail piece or parcel. System 10 includes a reservoir 12 containing a moistening fluid 14, such as, for example, water or water with a biocide. A wick 16, preferably formed of a woven material, has a first end portion 18 disposed in the reservoir such that the first end portion 18 is submerged in the moistening fluid 14. Wick 16 includes a second end portion 20, not submerged in the moistening fluid 14, situated near an opening 22 in a feed deck 30. A mail piece, such as, for example, envelope 60, or a tape (not shown), traverses the feed deck 30 in the direction indicated by arrow 32. The envelope 60 is situated on the feed deck 30 such that a flap 62 of the envelope 60 faces the feed deck 30. Flap 62 includes a glue line 64.

The opening 22 exposes the end portion 20 of the wick 16. An applicator assembly 24 is disposed adjacent to and spaced slightly above the feed deck 30. Applicator assembly 24 includes a contact media 26, such as, for example, a brush, foam or felt. The contact media 26 is located adjacent to the end portion 20 of wick 16 such that the contact media 26 and end portion 20 of the wick 16 make contact with each other through the opening 22. Applicator assembly 24 is preferably pivotally secured via a constant torque torsion spring assembly 28 that provides a constant normal force on the applicator assembly 24 downward in the direction of the feed deck 30 as indicated by arrow 38, thereby ensuring contact between the contact media 26 and the end portion 20 of the wick 16. The wick 16 transfers moistening fluid 14 from the first end 18 to the second end 20. Moistening fluid 14 is then transferred from the second end portion 20 of the wick to the contact media 26. As the envelope 60 traverses the feed deck 30, the body of the envelope 60 will pass over the top of the applicator assembly 24 while the flap 62 will pass under the applicator assembly 24 between the contact media 26 and the end portion 20 of the wick 16. Moistening fluid 14 will be transferred from the contact media 26 to the glue line 64 of the envelope flap 62.

According to the present invention, the moistening system 10 compensates for a decrease in the amount of moistening fluid 14 contained in the reservoir 12 by automatically increasing the normal force between the applicator assembly 24 and wick 16 as the level of the moistening fluid 14 in the reservoir 12 decreases. The moistening system 10 includes a float 40 that has sufficient buoyancy to float on the top surface of the moistening fluid 14 in the reservoir 12. Thus, the height of the float 40 in the reservoir 12 is dependent upon level of the moistening fluid 14 in the reservoir 12. The float 40 has a connection device, such as, for example, a tension spring 42, attached thereto. Float 40 can be, for example, a polymeric sphere. The spring 42 is attached to the applicator assembly 24 at an attachment point 44, preferably located near the same end of the applicator assembly 24 where the applicator assembly 24 is secured by the torsion spring assembly 28, thereby not blocking an envelope flap 62 or tape passing beneath the applicator assembly 24. Contact point 44 is preferably located forward of the pivot point of the applicator assembly 24 such that any force on the contact point 44 will cause an additional force in the direction of arrow 38. Float 40 may optionally be pivotally secured by a rod 46 to an attachment point 48 on the reservoir 12 for stabilization.

Figure 2:
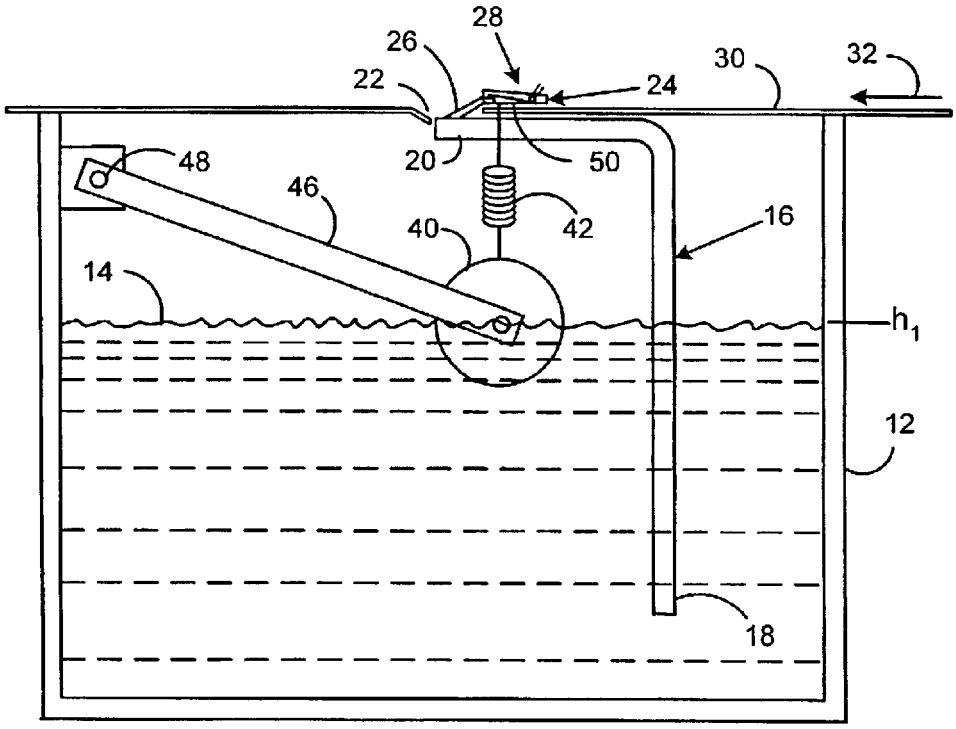
FIG. 2 illustrates a side view of the self-adjusting moistening system according to the present invention with the moistening fluid at a first level.

The operation of the moistening system 10 will be described with respect to FIGS. 2 and 3, which illustrate side views of the moistening system 10 with the moistening fluid 14 at a first level ($h_1$) and a second level ($h_2$), respectively. When the reservoir 12 is full or near full, the level of the moistening fluid 14 is at a height $h_1$. When the level of the moistening fluid 14 is at $h_1$, the spring 42 is preferably substantially unloaded, i.e., not under tension, and therefore does not contribute to the force imparted between the contact media 26 and end portion 20 of the wick 16. Preferably, the buoyancy of the float 40 on the surface of the moistening fluid 14 supports the weight of the spring 42, and thus only the torsion spring assembly 28 (if provided) exerts a force which causes the contact media 26 to physically contact the end portion 20 of the wick 16. The end portion 20 of the wick 16 will transfer the moistening fluid 14 to the contact media 26. The contact media 26 will then transfer the moistening fluid 14 to the flap 62 of an envelope 60 or a tape (not shown) as it passes in the gap 50 between the applicator assembly 24 and feed deck 30 and between the contact media 26 and end portion 20 of wick 16 in the direction of arrow 32.

Figure 3:
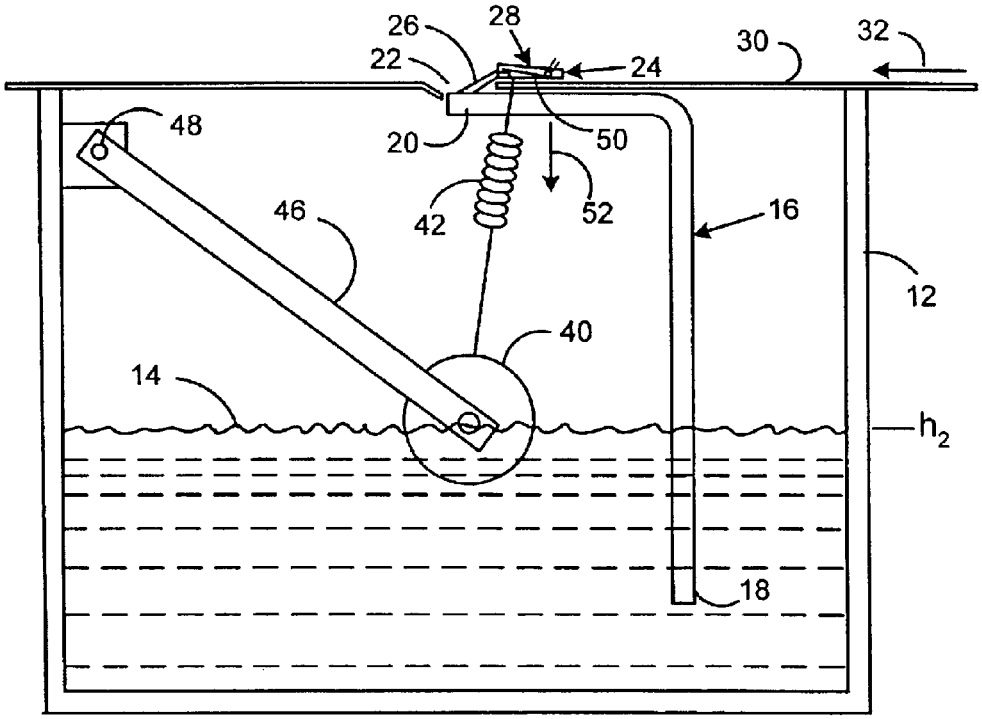
FIG. 3 illustrates a side view of the self-adjusting moistening system according to the present invention with the moistening fluid at a second level.

Referring now to FIG. 3, there is illustrated a side view of the moistening system 10 after a period of use of the moistening system 10 thereby lowering the moistening fluid 14 to a second level $h_2$ lower then the first level $h_1$. As the level of moistening fluid 14 in the reservoir 12 decreases, the height of the float 40 will also decrease, thereby extending the spring 42. As the spring 42 elongates, it will impart a force on the applicator assembly 24 in the general direction indicated by arrow 52. This force is proportional to the spring constant k for the spring 42 and the difference in height of the moistening fluid level 14 and can be calculated as follows:

$$\text{Force } (F)=k^*(h_1-h_2)$$

Thus, as the level of the moistening fluid 14 in the reservoir 12 decreases, the force F imparted on the applicator assembly 24 by spring 42 proportionally increases. The force from the spring 42 will add to the force imparted between the contact media 26 and end portion 20 of the wick 16 by the torsion spring assembly 28, thereby increasing the pressure with which the contact media 26 contacts the end portion 20 of the wick 16. Thus, a larger amount of force will be imparted between the contact media 26 and the end portion 20 of wick 16 as the level of moistening fluid 14 decreases. This greater force will also be applied between the contact media 26 and the flap 62 of an envelope 60 or a tape (not shown) as it passes between the contact media 26 and end portion 20 of wick 16 in the direction of arrow 32. Of course, the spring constant k should be selected such that the total force F imparted on the applicator assembly 24 when the float is at its lowest level in the reservoir 12 will not prevent the flap 62 of an envelope 60 or a tape from passing between the contact media 26 and end portion 20 of the wick 16.

The increase in force imparted between the contact media 26 and the end portion 20 of the wick 16, proportional to the amount of moistening fluid 14 in the reservoir 12, allows the moistening system 10 to self-adjust based on the amount of moistening fluid 14 in the reservoir 12. As the level of moistening fluid 14 in the reservoir 12 decreases, the proportional increase in force between the contact media 26 and end portion 20 of the wick 16, due to the spring 42, will cause an increase in the amount of moistening fluid 14 deposited on an envelope flap 62 or tape. Specifically, the increased force between the contact media 26 and end portion 20 of wick 16 will cause additional moistening fluid 14 to be transferred from the wick 16 to the contact media 16. This, coupled with the increased force applied by the contact media 26 to an envelope flap 62 or tape as it passes between the contact media 26 and end portion 20 of wick 16, will cause an increase in the amount of moistening fluid 14 deposited on the envelope flap 62 or tape by the contact media 26.

Thus, when the reservoir 12 is full or near full, the additional force between the contact media 26 and end portion 20 of wick 16 from spring 42 is negligible or very small, thus preventing an over-wetting condition from occurring. As the level of the moistening fluid 14 in the reservoir 12 decreases, the force from spring 42 will proportionally increase, causing additional moistening fluid 14 to be transferred to an envelope flap or tape, thereby preventing an under-wetting condition from occurring.

Thus, according to the present invention, a self-adjusting moistening system that compensates for a decrease in the amount of moistening fluid contained in the reservoir by automatically increasing the normal force between the applicator and wick as the moistening fluid level in the reservoir decreases is provided. The self-adjusting moistening system of the present invention provides better control over the amount of moistening fluid deposited on an envelope flap, thereby ensuring more consistent sealing, while also reducing the likelihood of an over-wetting condition when the reservoir is full. Those skilled in the art will also recognize that various modifications can be made without departing from the spirit of the present invention. For example, the tension spring 42 can be replaced by a static device, such as, for example, a link, such that when the level of moistening fluid 14 drops below a certain level, the float 40 will be suspended by the connection device above the level of the moistening fluid 14 and the weight of the float 40 and connection device will provide additional force between the contact media 26 and end portion 20 of the wick 16.

While a preferred embodiment of the invention has been described and illustrated above, it should be understood that this is exemplary of the invention and is not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A moistening device comprising:

a reservoir to contain a moistening fluid;

a wick having a first portion located in the reservoir;

an applicator device having a portion in physical contact with a second portion of the wick, the second portion of the wick transferring moistening fluid to the applicator device, the applicator device transferring moistening fluid to a media when the media contacts the applicator device, the physical contact having an associated contact pressure between the portion of the applicator device and the second portion of the wick; and an adjustment device coupled to the applicator device, the adjustment device adjusting the contact pressure between the portion of the applicator device and the second portion of the wick based at least in part on a level of the moistening fluid in the reservoir.

2. The moistening device according to claim 1, wherein the adjustment device further comprises:

a float device located in the reservoir; and a connection device to couple the float device to the applicator device, wherein the contact pressure is based at least in part on a level of the float in the reservoir.

3. The moistening device according to claim 2, wherein the connection device is a spring.

4. The moistening device according to claim 3, wherein when the reservoir is substantially full of moistening fluid, the float device will be at a first level and the spring will be substantially unloaded.

5. The moistening device according to claim 4, wherein when the reservoir is less than full of moistening fluid, the float device will be at a second level less than the first level and the spring will be elongated.

6. The moistening device according to claim 5, wherein the contact pressure is proportional to a difference between the first level and the second level.

7. The moistening device according to claim 1, wherein the applicator device further comprises:

a contact media, the contact media being in physical contact with the second portion of the wick.

8. The moistening device according to claim 7, wherein the contact media is a brush.

9. The moistening device according to claim 1, wherein the adjustment device further comprises:

a spring coupled to the applicator device, the spring providing a first contact pressure between the portion of the applicator device and the second portion of the wick, wherein the contact pressure between the portion of the applicator device and second portion of the wick will vary between the first contact pressure and a second contact pressure based on the level of the moistening fluid in the reservoir.

10. The moistening device according to claim 9, wherein the first contact pressure is a constant contact pressure.

11. A mailing system comprising:

a moistening device to deliver moistening fluid to a media, the moistening device comprising:

a reservoir to contain the moistening fluid;

a wick having a first portion and a second portion, the first portion submerged in the moistening fluid;

an applicator device having a portion in physical contact with the second portion of the wick, the second portion of the wick transferring moistening fluid to the applicator device, the applicator device transferring moistening fluid to the media when the media contacts the applicator; and an adjustment device coupled to the applicator device, the adjustment device adjusting a contact pressure between the portion of the applicator device in physical contact with the second portion of the wick based at least in part on a level of the moistening fluid in the reservoir.

12. The mailing system according to claim 11, wherein the adjustment device further comprises:

a float device located in the reservoir, the float device floating on the moistening fluid; and a spring to couple the float device to the applicator device, wherein as the level of the moistening fluid in the reservoir decreases, a height of the float device in the reservoir decreases thereby elongating the spring to provide a force on the applicator device, the force on the applicator device increasing the contact pressure between the portion of the applicator device in physical contact with the second portion of the wick.

13. The mailing system according to claim 12, wherein when the reservoir is substantially full of moistening fluid, the float device is at a first height and the spring is substantially unloaded such that there is no increase in the contact pressure between the portion of the applicator device and the second portion of the wick caused by the float device and spring.

14. The mailing system according to claim 13, wherein when the float device is at a second height less than the first height, the increase in the contact pressure between the portion of the applicator device and the second portion of the wick is proportional to the difference between the first height and the second height.

15. The mailing system according to claim 14, wherein the increase in the contact pressure is equal to the difference between the first height and the second height multiplied by a spring constant for the spring.

16. The mailing system according to claim 11, wherein the applicator device further comprises:

a contact media, the contact media being in physical contact with the second portion of the wick.

17. The mailing system according to claim 16, wherein the contact media is a brush.

18. The mailing system according to claim 16, wherein the contact media is foam.

19. The mailing system according to claim 16, wherein the contact media is felt.

20. The mailing system according to claim 11, wherein the adjustment device further comprises:

a spring coupled to the applicator device, the spring providing a constant first contact pressure between the portion of the applicator device and the second portion of the wick, wherein the contact pressure between the portion of the applicator device and second portion of the wick will vary between the first contact pressure and a second contact pressure based on a level of the moistening fluid in the reservoir.

21. The mailing system according to claim 11, wherein the mailing system is a mailing machine.

22. The mailing system according to claim 11, wherein the mailing system is an inserter device.

23. The mailing system according to claim 11, wherein the media is an envelope, and the moistening fluid is transferred from the applicator device to a flap of the envelope.

24. The mailing system according to claim 11, wherein the media is a tape.

25. A moistening system comprising:

means for storing a moistening fluid;

means for applying the moistening fluid to a media;

means for transferring the moistening fluid stored in the storing means to the applying means, the moistening fluid being transferred from the transfer means to the applying means by contact pressure between the transfer means and the applying means; and means for automatically adjusting the contact pressure between the transfer means and the applying means based on a level of moistening fluid in the storage means.

26. The moistening system according to claim 25, wherein the storage means comprises a reservoir.

27. The moistening system according to claim 25, wherein the applying means comprises a brush.

28. The moistening system according to claim 25, wherein the transfer means comprises a wick.

29. The moistening system according to claim 25, wherein the adjustment means comprises:

a float device located in the storage means, the float device floating on the moistening fluid; and a spring to couple the float device to the applying means, wherein as a level of the moistening fluid in the storage means decreases, a height of the float device in the storage means decreases thereby elongating the spring to provide a force on the applying means, the force on the applying means increasing the contact pressure between the transfer means and the applying means.

30. A method for controlling an amount of moistening fluid being transferred from an applicator device to a media, the method comprising:

wicking moistening fluid, using a wick, from a reservoir containing an amount of moistening fluid;

transferring moistening fluid from the wick to the applicator device via contact pressure between the wick and applicator device;

transferring the moistening fluid from the applicator device to the media when the media passes between the applicator device and wick and contacts the applicator device;

lowering a float device floating on the moistening fluid in the reservoir as the amount of moistening fluid in the reservoir decreases, the float device being coupled to the applicator device; and exerting a force on the applicator device based on the lowering of the float device, the force causing an increase in the contact pressure between the wick and the applicator device as the amount of moistening fluid in the reservoir decreases.

* * * * *